US005527131A

United States Patent [19]

Salmond et al.

[11] Patent Number: 5,527,131

[45] Date of Patent: Jun. 18, 1996

[54] LIQUID-BLOCKING RING ASSEMBLY FOR SURFACE DRAINS

[75] Inventors: Charles N. Salmond; Cabot E. Long, both of Virginia Beach, Va.

[73] Assignee: The United States of America as represented by the Secretary of the Navy, Washington, D.C.

[21] Appl. No.: 300,241

[22] Filed: Sep. 1, 1994

[51] Int. Cl.[6] ..... E02B 3/16

[52] U.S. Cl. ..... 405/52; 210/163; 405/303

[58] Field of Search ..... 405/52, 36, 303, 405/42; 210/163, 164

[56] References Cited

U.S. PATENT DOCUMENTS

| | | | |
|---|---|---|---|
| 2,859,875 | 11/1958 | Wilkie | 210/163 |
| 3,828,931 | 8/1974 | Henricksen | 210/163 |
| 4,035,297 | 7/1977 | Aldridge et al. | 210/163 |
| 4,487,690 | 12/1984 | Logsdon | 405/36 |
| 4,630,962 | 12/1986 | Thomann et al. | 404/2 |
| 4,838,732 | 6/1989 | Clark et al. | 405/52 |
| 5,141,633 | 8/1992 | Walczak et al. | 210/163 |

OTHER PUBLICATIONS

Lab Safety Supply, 1994 General Catalog, 1994 Winter/Spring Edition, p. 610.

*Primary Examiner*—Dennis L. Taylor
*Attorney, Agent, or Firm*—Thomas E. McDonald; William F. McCarthy

[57] ABSTRACT

A light-weight, liquid-blocking ring assembly for a surface drain for preventing a harmful liquid spilled nearby from entering the drain, which can be quickly and easily installed by a single person, and includes positive verification that none of the undesired liquid has entered the drain. The assembly includes (1) a center portion having a latching mechanism for attaching and drawing the assembly towards the drain, (2) a peripheral band which surrounds and is spaced from the drain, and which carries at its bottom edge a resilient gasket conformable to the surface surrounding the drain, and (3) an intermediate structure connecting the center portion and the peripheral band without blocking a clear view of the entire surface surrounding the drain.

8 Claims, 2 Drawing Sheets

LIQUID-BLOCKING RING ASSEMBLY FOR SURFACE DRAINS

BACKGROUND OF THE INVENTION

1. Technical Field

The invention relates generally to a ring assembly for a surface drain which prevents liquid flowing over the surface from entering the drain. In particular, the invention relates to a drain ring assembly for preventing aviation fuel spilled on a concrete apron during a aircraft fueling operation from entering a drain of a surface water drainage system for the concrete apron.

2. Background Art

At many airports, both military and commercial, aircraft fueling operations are performed on a concrete apron which slopes gradually to a number of storm drains of various shapes and sizes. In the past, whenever fuel is spilled onto the apron in sufficient quantity that the fuel will reach nearby storm drains, various covers or drop mats were placed over these nearby drains in an effort to prevent fuel from entering state waters. Industry drop mats suitable for storm drains are relatively expensive, generally several hundred dollars, and can only be used a few times. Also, these drop mats are generally too heavy to be carried about and installed by a single person. Further, when such drop mats are used during a fuel spill, there is no way of determining if any of the fuel got into any of the drains, and thus it was necessary to report many spills to the state as a possible violation of state and/or federal environmental regulations regarding pollution of state waters.

SUMMARY OF THE INVENTION

It is an object of the invention to provide a light-weight liquid-blocking ring assembly for a surface drain, which prevents liquid flowing over the surface from entering the drain, and which can be easily and quickly installed by a single person.

It is a further object of the invention to provide such a light-weight liquid-blocking drain ring assembly, in which the ring assembly is relatively inexpensive to manufacture, can be used for many operations, and includes wearable elements which are quickly and easily replaced.

It is another object of the invention to provide a light-weight liquid-blocking drain ring assembly which can be quickly and easily installed by a single person to prevent the entrance of aviation fuel or other environmentally harmful liquids spilled nearby.

It is a still further object of the invention to provide such a liquid-blocking drain ring assembly, in which the ring assembly includes positive verification that none of the undesired liquid has entered the drain.

It is still another object of the invention to provide a liquid-blocking drain ring assembly which is attached to, and utilizes the weight of a standard load-bearing perforated drain cover to press the periphery of the ring assembly against the surface surrounding the drain.

In a liquid-blocking ring assembly for a surface drain, according to the invention, for preventing a liquid flowing over the surface from entering the drain, the support structure is formed of lightweight material, e.g., aluminum or plastic composites, and includes: (1) a circular band which is larger in diameter than the diameter of the largest drain to be protected, for carrying at its bottom edge a gasket of resilient material which is conformable to the surface surrounding the drain and which is impervious to the liquid, the circular band having a width greater than the expected height of flowing liquid to be blocked from entering the drain: (2) a relatively small center plate carrying a mechanism for engaging and drawing the liquid-blocking cover against the drain; and (3) structural members connecting the peripheral band and the center plate without blocking a clear view of the entire surface surrounding the drain.

BRIEF DESCRIPTION THE DRAWINGS

The invention will be better understood, and further objects, features, and advantages thereof will become more apparent from the following description of a preferred embodiment, taken in conjunction with the accompanying drawings in which.

DESCRIPTION OF A PREFERRED EMBODIMENT

Figure 1:
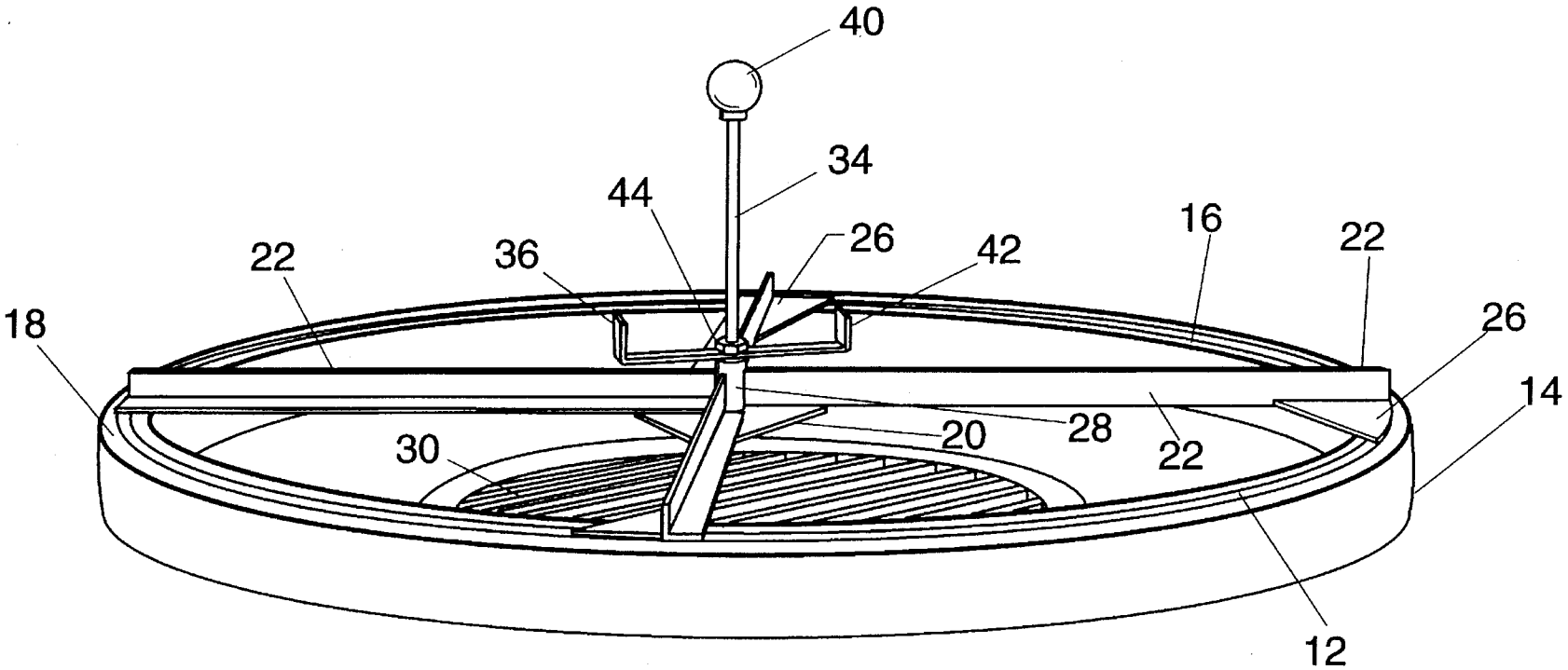
FIG. 1 is a perspective view of the preferred embodiment of the invention, attached to a storm drain disposed in a concrete apron.
Figure 2:
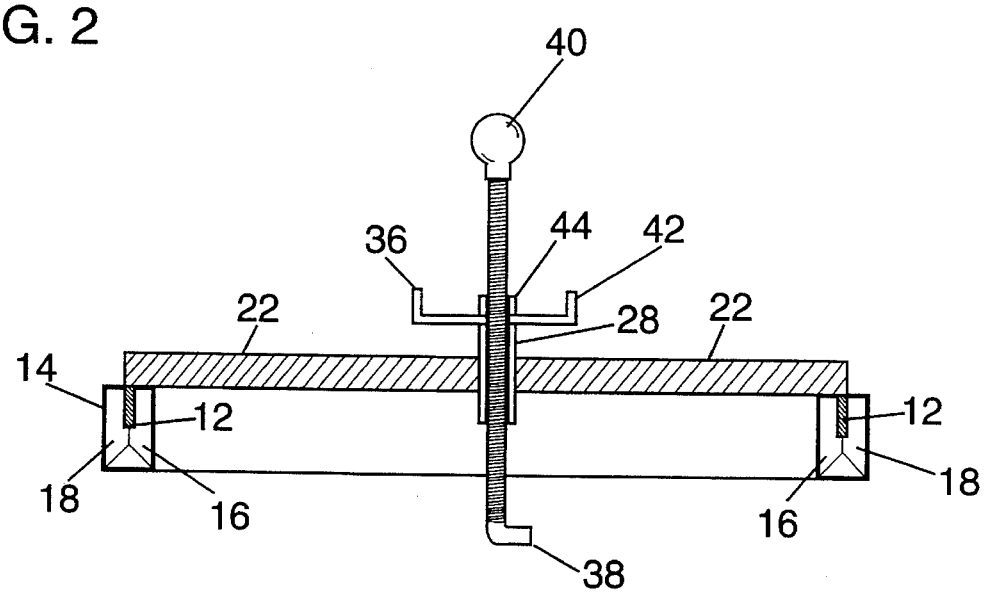
FIG. 2 is a cross-sectional side view of the preferred embodiment of the invention, taken along the line 2—2 of FIG. 3.
Figure 3:
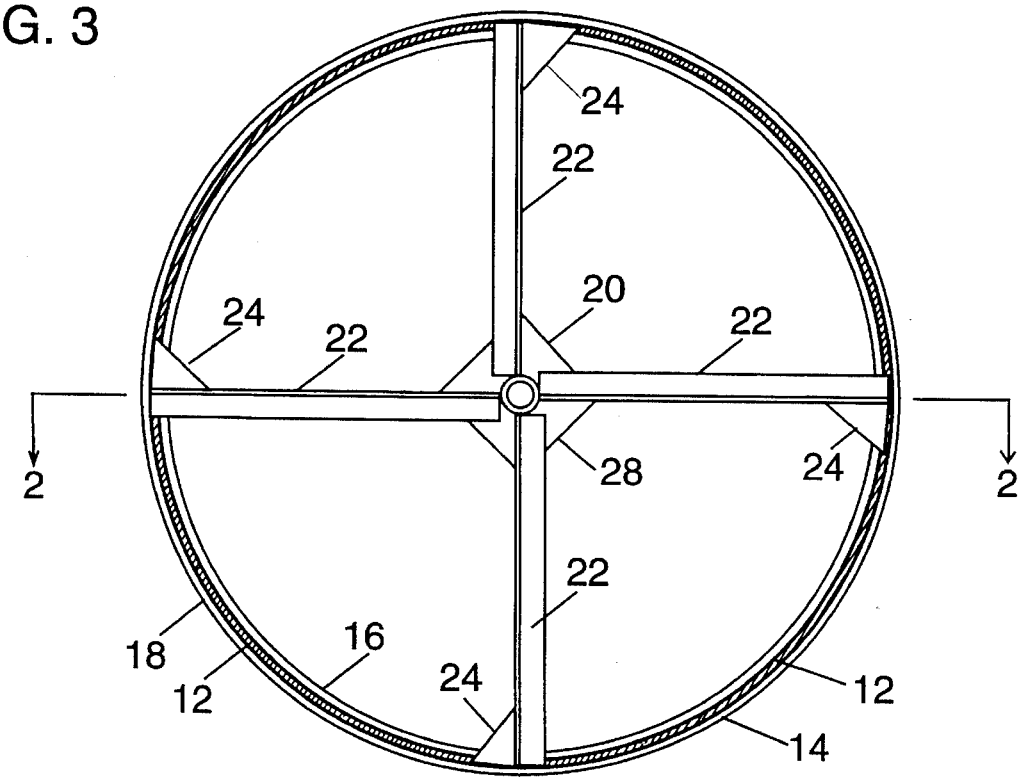
FIG. 3 is a plan view of the preferred embodiment of the invention, with the latching mechanism 26 removed.

The ring assembly 10 shown in FIGS. 1–3 includes a circular aluminum band 12 at its periphery. The band 12 is two inches high, ¼ inch thick, and approximately sixty inches in diameter. A sealing gasket 14 is affixed to the vertical sides and bottom edge of the band 12. The gasket 14 is formed of two strips 16, 18 of resilient material which is impervious to aviation fuel. Each strip 16, 18 has a thickness of approximately one inch, a maximum width of approximately four inches, and one 45 degree beveled edge along the length of the strip. The minimum width sides of the inner strip 16 and the outer strip 18 are affixed respectively to inner and outer vertical sides of the band 12, and to each other, by a contact glue, to form the gasket 14, having a V-shaped bottom surface, as shown in FIG. 2. In the embodiment of the invention described herein, the strips 16, 18 were cut from a one inch thick sheet of a closed cell foam rubber material manufactured by Armstrong under the trade name ARMAFLEX, Armstrong Catalog No. 6416, and were glued together and to the band 12 by contact glue supplied by Allied Materials, Norfolk, Va., Catalog No. 6416.

The top side of the circular aluminum band 12 is structurally connected to a ten inch square, ¼ inch thick, center plate 20 by four radially-extending, aluminum, 2"×2"×¼" angle bars 22, each having inner ends welded to the center plate 20 and outer ends welded to the aluminum band 12. Additional support is provided by four aluminum gusset plates 24 which are welded to the band 12 and to the four aluminum angle bars 22 and gusset plates 24, respectively. Because the structural support bars 22 are relatively narrow compared with the inner perimeter of the sealing gasket 14 and are spaced at a distance from the surface on which the ring assembly 10 rests, the entire portion of that surface disposed between the center plate 20 and the sealing gasket 14 can be easily observed and inspected visually. Also, because of the narrow widths of the structural support bars 22 and gusset plates 24, most of the inner periphery of the gasket 14 and most of the entire surface within the inner periphery of the gasket 14 surrounding the drain are visible in a plan view of the ring assembly 10.

The ring assembly 10 includes a latching mechanism 26 to secure the ring assembly to a slotted, load-bearing drain cover 30 normally used to prevent solid objects from falling into the drain 32 and to provide support to persons or vehicles moving over the drain. This latching mechanism 26 includes: (1) an open-ended cylindrical, aluminum sleeve 28 which extends through an axial bore of the center plate 20 and which is welded to the center plate 20 and to the four angle bars 22; (2) a threaded, ⅝ inch diameter, steel rod 34, which extends vertically through the sleeve 28; and (3) a latch handle 36 which is threadedly engaged with the rod 34. The bottom end portion 38 (about two inches) of the rod 34 is bent approximately 90° degrees to engage the existing storm drain cover 30. A knob 40 is fastened to the top end portion of the rod 34 to prevent the sharp top end of the rod 34 from scratching or otherwise damaging objects rubbing against it. This knob 40 also serves as a handhold during installation of the ring assembly 10.

The top end surface of the sleeve 28 serves as a bearing surface for the latch handle 36. The handle 36 includes (1) a flat metal bar 42 having upturned ends and a center bore of the same diameter as the inner diameter of the sleeve 28, and (2) a threaded nut 44, which is welded to the top side of the bar 42 concentric with the bar center bore and which is threadedly engaged with the rod 34. The rod 34 is moved to a fully extended position by rotating the latch handle 36 in a first direction of rotation to move the latch handle 36 along the rod 34 until it is adjacent the knob 40. In its fully extended position, the rod 34 can be freely raised or lowered manually by a person holding the rod 34 by the knob 40. The rod 34 is moved to a fully retracted, fixed position by rotating the latch handle 36 in a second, opposite direction of rotation to move the latch handle 36 along the rod 34 until the bent bottom end portion 38 is pulled tight against the bottom end of the sleeve 28 and the latch handle is tight against the top end of the sleeve 28.

The rod 34 must be of sufficient length such that, when it is fully extended downward, it will extend completely through and beyond a central slot 46 in the load-bearing drain cover to its bottom end portion 38.

The diameter of the ring 12 (60 inches) was selected to be appreciable larger than the diameter of the largest surface drain of the concrete aprons used for aircraft fueling operations at Oceana Naval Air Station, Virginia Beach, Va., so that a sufficient width of the entire surface within the inner perimeter of the sealing gasket 14 and surrounding the drain is visible to an observer so that he can readily determine by visual inspection if any spilled fuel has flowed across this surface and into the drain.

Several ring assemblies 10, which weigh less than fifteen pounds each, can be carried in a maintenance vehicle normally present at the aircraft fueling site. When a fuel spill occurs, one person can easily carry one of the ring assemblies 10 to a "threatened" surface drain 32, i.e., one disposed in the projected path of the spilled fuel, and quickly secure it to the drain. First, the ring assembly 10 is placed concentrically over the drain so that all of the annular-shaped surface adjacent the drain and surrounded by the sealing gasket 14 is visible to the installer. If the rod 34 is not already in its extended position, the installer holds the rod 34 up by the knob 40, and twirls the latch handle 36 in the first direction of rotation until it is adjacent the knob 40. The installer then, in sequence, (1) turns the knob 40 so that the bent bottom end portion 38 of the rod 35 extends in the same direction as the central slot 46 of the drain cover 30, (2) lowers the rod 34 to its fully extended position, (3) rotates the rod 34 by approximately 90° degrees, (4) raises the rod 34 by its knob 40 until the bent rod end portion 38 contacts the drain cover 30, (5) twirls the latch handle 36 in the second, opposite direction of rotation until it contacts the top end of the sleeve 28, and (6) continues the rotation of the latch handle 36 in the second direction of rotation to press the sealing gasket 14 tightly against the surface adjacent the drain and prevent any of the spilled fuel from flowing between the surface and the gasket 14 into the drain 32. Generally, this entire installation sequence can be easily performed by a single installer in less than a minute.

After fuel flow has reached the ring assembly 10, the installer can visually check the surface adjacent the inner perimeter of the sealing gasket 14 to make sure none of the spilled fuel has flowed between the sealing gasket 14 and the surface. If there is a slow leakage of fuel, the installer may be able to further tighten the latch handle 36 to stop it, and remove the fuel from the surface before it reaches the drain.

The ring assembly 10 can be used with non-circular drains, e.g., square or rectangular drains, so long as the sealing gasket 14 is spaced from the drain to allow any fuel flow beneath the gasket 14 to be readily detected by visual observation. Also, the band 12 need not be circular in shape, if another shape can better accommodate all of the drains of the concrete apron being used as an aircraft fueling site. For example, where most of the drains are circular but a rectangular drain has the largest length, an band 12 shaped as an ellipse or as a rectangle with rounded corners may be better than a circular band 12.

To secure the ring assembly 10 to storm drain covers having round or square perforations as well as storm drain covers having slotted perforations, the rod 34 can have a straight bottom end portion with one or more pivoted elements which pivot inward towards the axis of the rod 34 to a retracted position (minimal cross-section) when passing through a drain cover opening, then pivot outward to an extended position (maximum cross-section) to allow these elements to engage the drain cover when the rod 34 is raised. These pivotable elements can be spring loaded or can be pivoted off-center so that, after passing through a drain cover opening, these elements pivot to the normal fully extended position. Another way to use the ring assembly 10 with a storm drain having a drain cover with very small openings (screen) or having drain cover is to attach the rod 34 to a bracket or ring bolt disposed within the drain, after removing the non-standard drain cover.

There are many modifications, variations, and/or additions to the preferred embodiment of the invention described above which would be obvious to one skilled in the art. For example, the sealing gasket 14 can be made of neoprene or other resilient materials unaffected by aviation fuel and the like, and can be constructed of a single formed strip and clamped, rather than glued, to the band 12. The band 12 can be made of a strong, light-weight material, other than aluminum or aluminum alloy, such as fiberglass or various polymer materials. In view of this, it is intended that the scope of the invention be limited only by the appended claims.

What is claimed and desired to be secured by Letters Patent of the United States is:

1. A device for preventing a liquid flowing over a hard liquid-impervious surface from entering a drain of said surface, which comprises:

a support structure, including a central portion, a peripheral band portion having a top edge and a bottom edge, and an intermediate connecting portion for affixing the peripheral band portion to the central portion;

a gasket of resilient material which is affixed to the peripheral band portion of the support structure, said gasket being impervious to said liquid and conformable to the surface about the drain over which liquid flows to enter the drain, said gasket being disposed along the bottom edge of the peripheral band portion, wherein the band and gasket assembly has a height greater than the anticipated depth of the flowing liquid and has an inner periphery of a size and shape such that the band and gasket assembly can be disposed on the surface to completely surround and be spaced from the drain; and latching means, disposed on the central portion of the support structure, for attaching and drawing the device towards the drain so as to press the gasket of resilient material carried by the peripheral band against the surface surrounding the drain with sufficient force to prevent the flow of liquid therebetween;

wherein the intermediate connecting portion of the support structure comprises a plurality of spaced-apart members, each affixed to and extending between the central portion and the top side of the peripheral band portion, the number and widths of the intermediate connecting portion members being such that most of the inner periphery of the gasket and most of the entire surface within the inner periphery of the gasket and surrounding the drain is visible in a plan view of the device, each intermediate connecting portion member being spaced at a distance from said surface so as to allow the entire surface within the inner periphery of the gasket and surrounding the drain to be readily observed and inspected visually after the device has been installed.

2. A device, as described in claim 1, wherein the support structure is formed of a light-weight material whereby the device can be easily installed by a single person.

3. A device, as described in claim 2, wherein the light-weight support structure material comprises aluminum.

4. A device, as described in claim 1, wherein:

the hard liquid-impervious surface constitutes an aircraft fueling area;

the liquid is aircraft fuel spilled on the surface;

the surface drain is a storm drain having a load-bearing perforated cover; and the latching means comprises a rod which extends downward though a perforation of the drain cover to a bent end, and means for raising the rod to engage the bent rod end with the drain cover.

5. A device, as described in claim 4, wherein at least an upper portion of the latching means rod is threaded, and the latching means further comprises:

an open-ended, vertically-disposed, cylindrical sleeve which is affixed to the support structure central portion and through which the latching means rod extends; and a latch handle, which bears against an upper end of the sleeve and is threadedly engaged with the latching means rod, for adjusting the vertical position of the latching means rod.

6. A light-weight liquid-blocking device for a surface drain to prevent an environmentally harmful liquid spilled nearby from entering the drain, which can be quickly and easily installed by a single person, comprising:

a support structure formed of light-weight material, including a central portion, a peripheral band portion having a top edge and a bottom edge, and an intermediate connecting portion for affixing the peripheral band portion to the central portion;

a gasket of resilient material which is impervious to said liquid and which is conformable to the surface about the drain over which the liquid flows to enter the drain, said gasket being disposed along the bottom edge of the peripheral band portion, wherein the band and gasket combination has a height greater than the anticipated maximum depth of spilled liquid, and has an inner periphery of a size and shape such that the band and gasket combination can be disposed on the surface to completely surround and be spaced from the drain; and latching means, disposed on the central portion of the support structure, for attaching and drawing the device towards the drain so as to press the gasket of resilient material carried by the peripheral band against the surface surrounding the drain with sufficient force to prevent the flow of liquid therebetween;

wherein the intermediate connecting portion of the support structure comprises a plurality of spaced-apart members, each affixed to and extending between the central portion and the top side of the peripheral band portion, the number and widths of the intermediate connecting portion members being such that most of the inner periphery of the gasket and most of the entire surface within the inner periphery of the gasket and surrounding the drain is visible in a plan view of the device, each intermediate connecting portion member being spaced at a distance from said surface so as to allow the entire surface within the inner periphery of the gasket and surrounding the drain to be readily observed and inspected visually after the device has been installed.

7. A device, as described in claim 6, wherein the minimum height of each intermediate connecting portion member above the surface surrounding the drain is approximately the same as that of the top side of the peripheral band portion to which the intermediate connecting portion member is affixed.

8. A device, as described in claim 1, wherein the minimum height of each intermediate connecting portion member above the surface surrounding the drain is approximately the same as that of the top side of the peripheral band portion to which the intermediate connecting portion member is affixed.

* * * * *